US005531023A

United States Patent [19]

Armstrong

[11] Patent Number: 5,531,023

[45] Date of Patent: Jul. 2, 1996

[54] METHOD OF MANUFACTURING MAMMOTH IVORY JEWELRY

[75] Inventor: John C. Armstrong, Calgary, Canada

[73] Assignee: Korite Minerals Limited, Alberta, Canada

[21] Appl. No.: 459,785

[22] Filed: Jun. 2, 1995

Related U.S. Application Data

[62] Division of Ser. No. 157,027, Dec. 1, 1993, Pat. No. 5,488,838.

[51] Int. Cl.[6] ..... B21F 43/00

[52] U.S. Cl. ..... 29/896.41

[58] Field of Search ..... 29/896.4, 896.41; 63/2, 26, 32

[56] References Cited

U.S. PATENT DOCUMENTS

| | | |
|---|---|---|
| 2,350,421 | 6/1944 | Schoder . |
| 2,353,995 | 7/1944 | Conner . |
| 2,763,079 | 9/1956 | Slovitt . |
| 3,412,575 | 11/1968 | Feldman . |
| 4,018,008 | 4/1977 | Young . |
| 4,809,417 | 3/1989 | Normann . |

FOREIGN PATENT DOCUMENTS

| | | |
|---|---|---|
| 2257155 | 6/1993 | United Kingdom . |

*Primary Examiner*—P. W. Echols

*Attorney, Agent, or Firm*—Fay, Sharpe, Beall, Fagan, Minnich & McKee

[57] ABSTRACT

A process for manufacturing mammoth ivory jewellery, comprising the steps of: (a) slow curing a supply of rough mammoth ivory for partially drying the rough mammoth ivory; (b) cutting the rough mammoth ivory into pieces; (c) further curing the pieces of rough mammoth ivory by heating the pieces in a vacuum oven for removing moisture therefrom; (d) pressure impregnating the pieces with suitable material for preventing moisture entry into the pieces; (e) inlaying gemstones between predetermined ones of the pieces to form composite pieces; (f) further pressure impregnating the composite pieces with the material for bonding the gemstones and mammoth ivory pieces; (g) removing a portion of the material from between the gemstones and mammoth ivory pieces so as to form a shallow bed in the composite pieces as such for eliminating cracking and separation of the gemstones and mammoth ivory pieces; (h) inlaying the shallow bed with gold alloy dust for aesthetic appearance in said pieces; and (i) processing the composite pieces to acquire a final shape and polished appearance.

11 Claims, 8 Drawing Sheets

FIG.9.
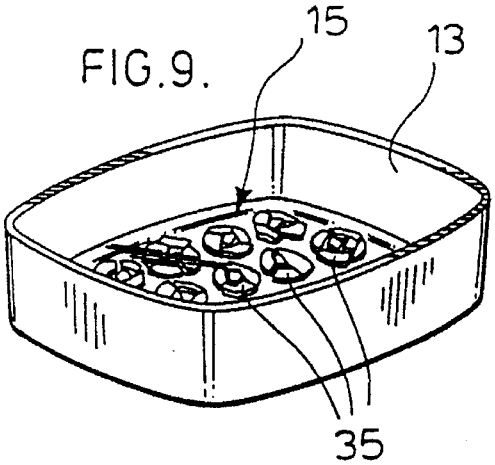
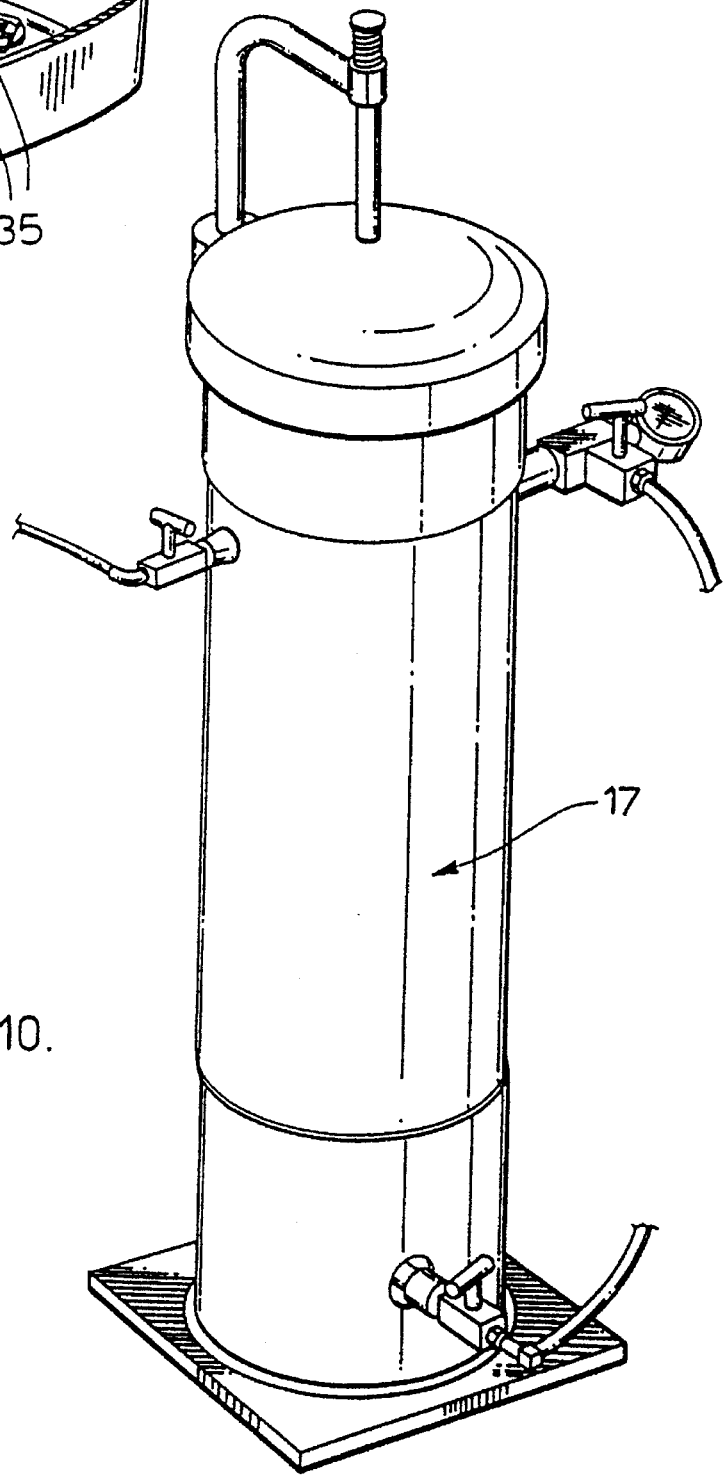
FIG.10.

FIG.16.
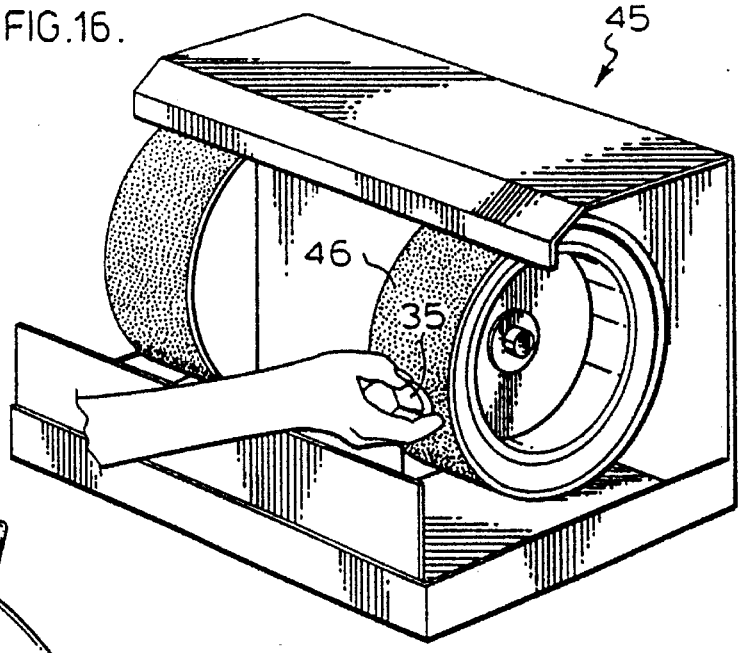
FIG.18.
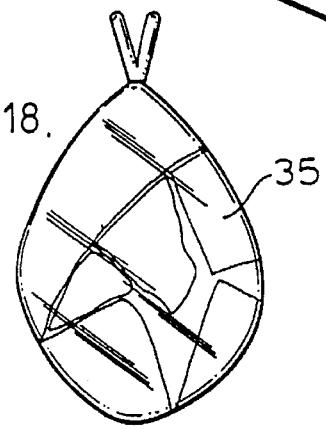
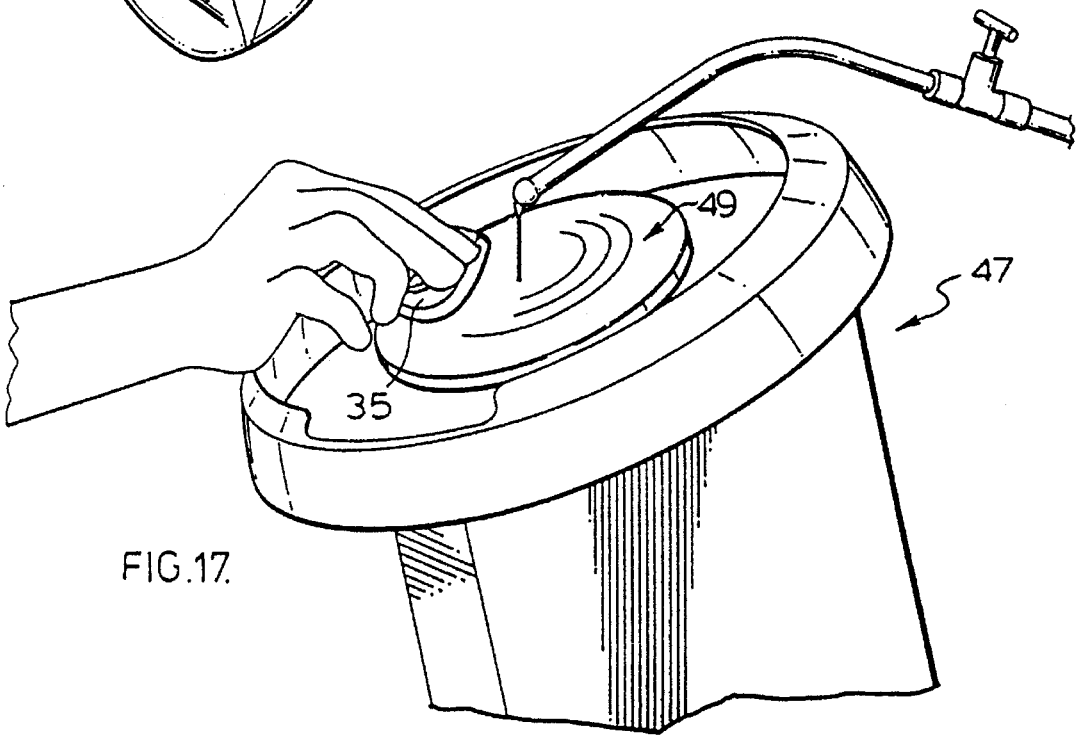
FIG.17.

METHOD OF MANUFACTURING MAMMOTH IVORY JEWELRY

This application is a divisional application of U.S. application Ser. No. 08/157,027 filed Dec. 1, 1993, now U.S. Pat. No. 5,488,838.

FIELD OF THE INVENTION

This invention relates in general to jewelry and more particularly to mammoth ivory jewelry and a process for the manufacture thereof.

BACKGROUND OF THE INVENTION

Attempts have been made in the past to construct jewelry utilizing mammoth ivory in combination with inlaid gemstones. A variety of such jewellery pieces are known such as mammoth ivory Hanko and mosaic mammoth ivory cabochons and mosaic mammoth ivory jewelry and object d'art.

The manufacture of such jewelry pieces has been difficult due to problems such as cracking of the mammoth ivory, cracking of the inlaid gemstones and separation of joints between the constituent materials (mammoth ivory, gemstones, adhesive material, etc). For example, exposure of the mammoth ivory to elements of water, permafrost and ground minerals results in cracks in the ivory, added moisture, weakened internal strength and contamination of the ivory composition. Furthermore, the combination of different constituent materials having different expansion rates contributes to the separation of the joints therebetween. Finally, the artistic design of the jewelry often presents problems in the bonding characteristics of the adhesive.

It has been determined that the main reason for movement in mammoth ivory is that the material is capable of absorbing enough moisture to reach its saturation point which causes expansion. Thus, as with wood, the raw material has to be cured to an acceptable relative humidity before further processing can be pursued. If the relative humidity is different than the ambient humidity, then there will be a transfer from the higher humidity level to the lower humidity level. This results in expansion or contraction of the piece, causing it to crack.

Attempts have been made in the prior art to overcome the problems discussed above.

Acrylic coatings have been applied to assembled pieces in order to act as a "cocoon" for sealing and binding the composite piece. However, the acrylic coatings have been found to be merely a temporary solution for two reasons. Firstly, since the raw material contains a certain amount of moisture, the moisture escapes through osmosis and tends to crack or separate the jewelry piece. Secondly, even if the moisture has been removed, available coatings are too soft to withstand long term usage. The results using this prior art solution include surface scratching and a discolouration of the coatings.

Oils have been applied in mammoth ivory jewellery pieces to replace natural oils lost due to the exposure of the ivory to natural elements. However, such oils have proven to be an unpleasureable experience for the craftsman to apply and for the consumer to wear.

Different adhesive materials have been utilized in an attempt to eliminate separation. Such adhesive materials come in many different varieties from polymers, epoxies, fibreglass and cyano-acrylids to name a few. Most available adhesives are designed to either penetrate materials or to act as binders, but not both. To date, no suitable adhesive material has been found which provides adequate penetration and binding characteristics for use in the construction of mammoth ivory jewelry.

Internal pins have also been inserted into mammoth ivory jewelry pieces in an attempt to eliminate separation. While the internal pins do solve the problem of keeping the piece together, the pins do not allow the jewelry piece to expand and contract in its desired surface direction. Therefore, the piece tends to buckle away from the direction of the pins. Furthermore, the use of pins in the production of jewelry has been found to be unduly expensive.

A variety of curing techniques have also been used in an attempt to reduce internal stress and moisture in mammoth ivory. Many forms of curing have been applied, from microwave ovens, hot lights in a heat box, to dry warehouse storage. All of these methods have been found to either destroy the material or to require excessive curing times.

SUMMARY OF THE INVENTION

According to the present invention, a combination of stabilization, construction, processing, and use of equipment has been used to address the problems inherent in the construction of mammoth ivory jewelry as well as the disadvantages and shortcomings of the previous approaches.

The cracking of the mammoth ivory has been overcome in the present invention by utilizing advanced methods of curing and stabilization. The cracking of inlaid gemstones has been overcome according to the present invention by constructing the jewelry piece in such a way as to allow for expansion and contraction without resulting in the different constituent materials applying pressure on each other. Careful choice of adhesive, construction steps, and advanced methods of curing and stabilization have resulted in a solution to the problems of separation and incomplete binding of the constituent materials.

BRIEF DESCRIPTION OF THE DRAWINGS

A detailed description of the preferred embodiment is provided herein below with reference to the following drawings, in which:

FIG. 9 shows the mammoth ivory pieces and inlaid gemstone pieces immersed in polymer epoxy within a tray, according to the process of the present invention;

FIG. 10 shows the pressure vessel of FIG. 6 with the lid closed;

FIG. 16 shows the assembled jewelry piece being shaped and curved utilizing an expandable drum sander, according to the process of the present invention;

FIG. 17 shows the assembled piece being further sanded to eliminate surface scratches utilizing a lapidary wheel; and FIG. 18 shows the resultant mosaic mammoth ivory jewelry piece according to the present invention.

DETAILED DESCRIPTION OF THE PREFERRED EMBODIMENT

As discussed above, the process of the present invention involves three parts: stabilization, construction and processing. The implementation of the process steps is effected using several pieces of specialized and standard equipment.

The stabilization process involves three steps for removing moisture from rough mammoth ivory and replacing it with a substitute material that is durable, which prevents transfer of moisture, which restricts expansion and contraction, and which does not cause discolouration.

Figure 1:
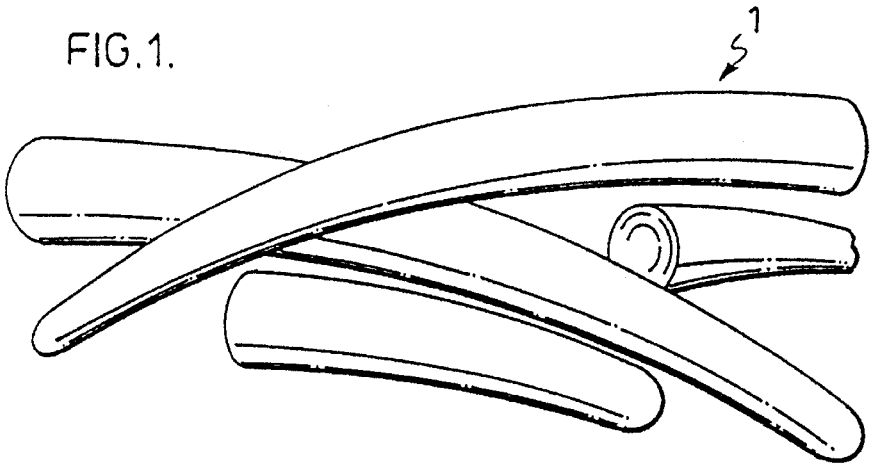
FIG. 1 shows a supply of mammoth ivory source material prior to stabilization.
Figure 2:
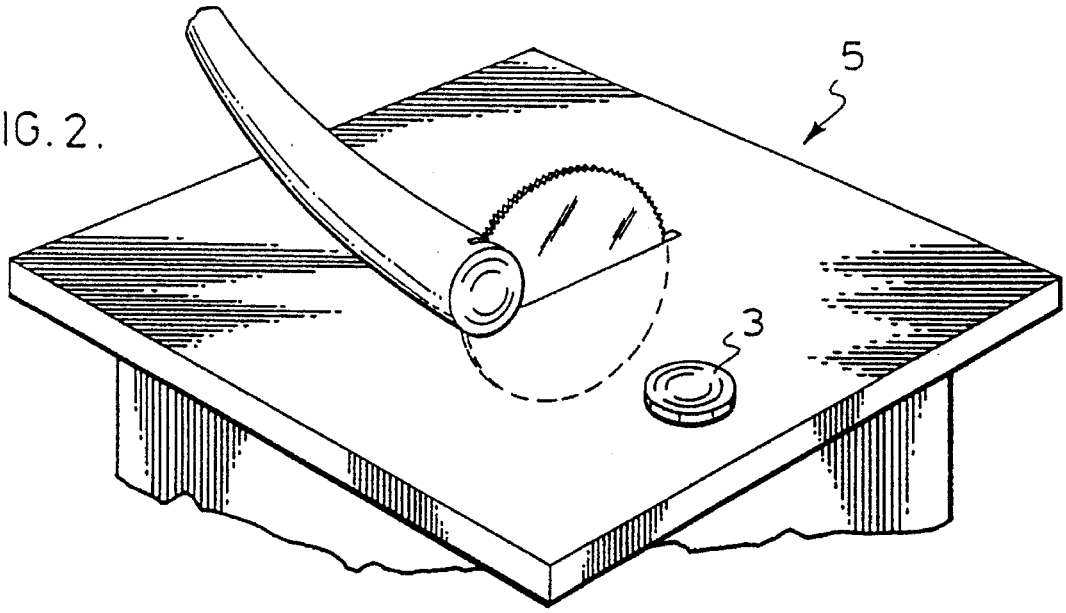
FIG. 2 shows the mammoth ivory being cut into slabs in accordance with the process of the present invention.
Figure 5:
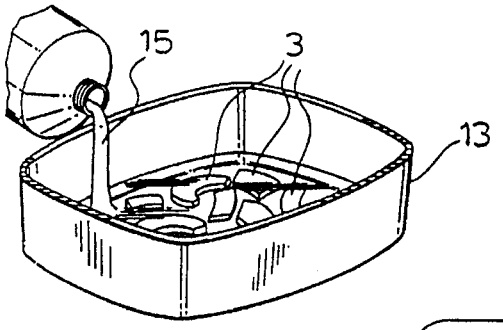
FIG. 5 shows cured pieces of mammoth ivory immersed in liquid epoxy according to the process of the present invention.
Figure 6:
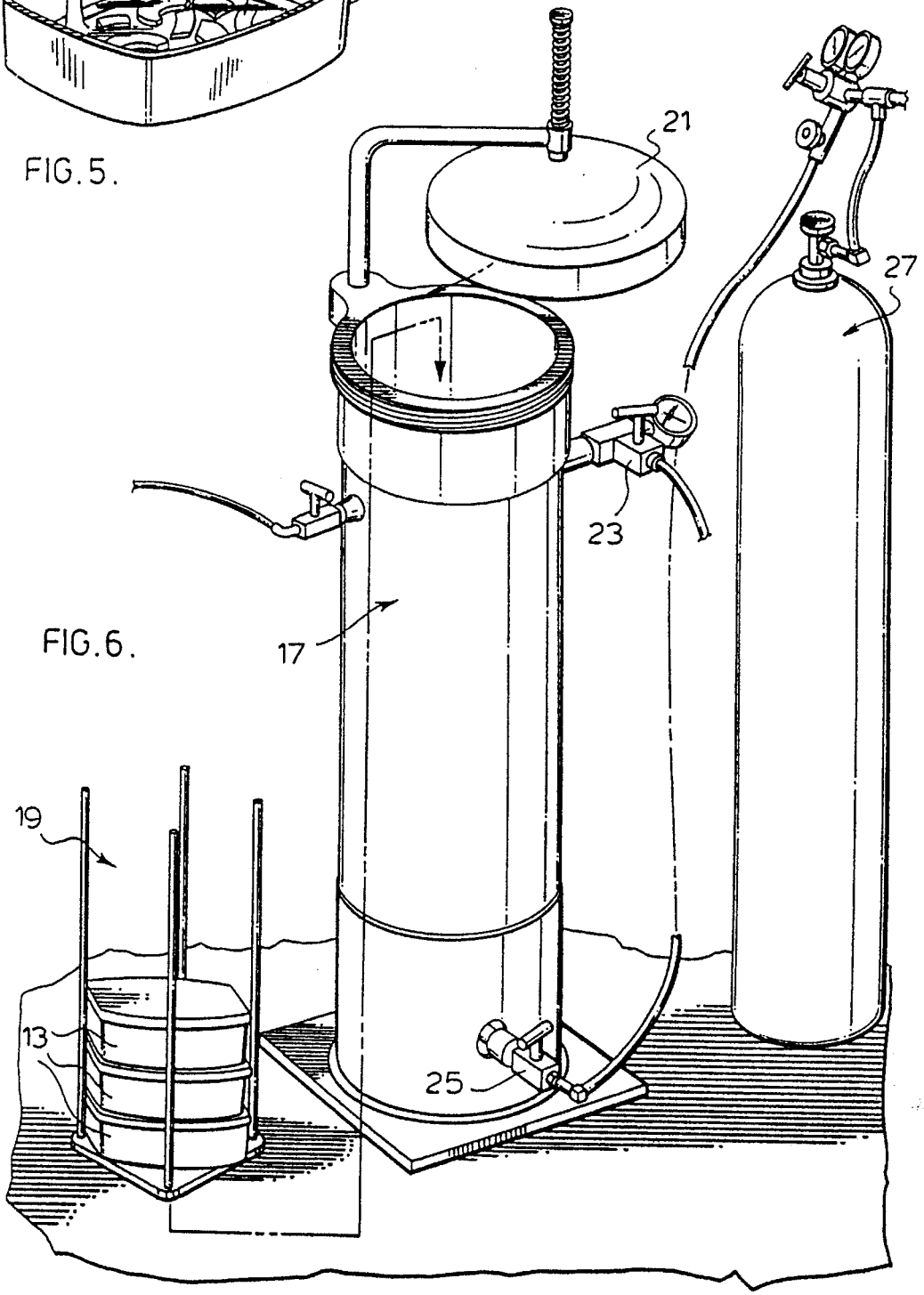
FIG. 6 shows a plurality of trays containing mammoth ivory pieces immersed in liquid epoxy inserted into a pressure vessel, according to the process of the present invention.

With reference to FIGS. 1 and 2, rough mammoth ivory 1 that has been slow cured is cut into slabs 3 using a rotary saw 5. The slabs are cut not thicker than approximately 3 cm in order to ensure adequate pressure impregnation of the mammoth ivory in a subsequent processing step discussed below with reference to FIGS. 5 and 6.

Slow curing of the rough mammoth ivory is effected by storing the ivory at high altitude in a dry climate for approximately two years. The high altitude and dry climate storage causes the rough mammoth ivory to dry partially prior to stabilization.

Figure 3:
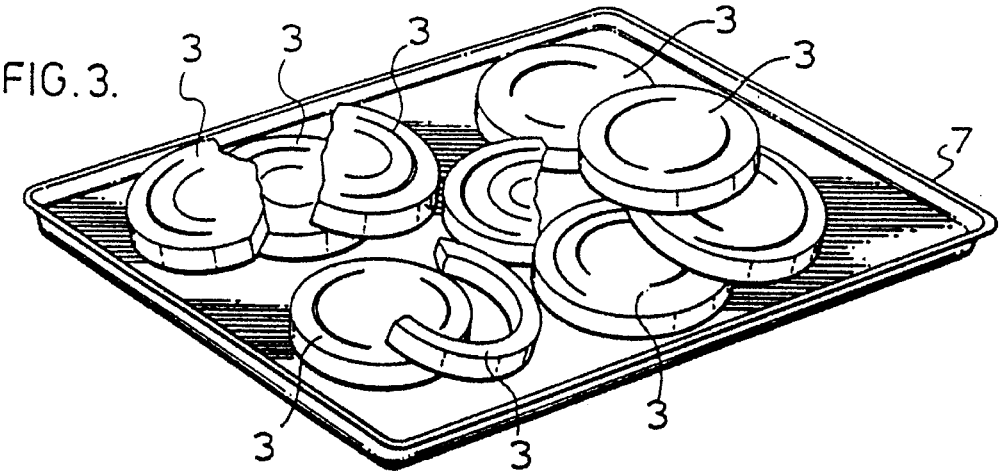
FIG. 3 shows the cut slabs of mammoth ivory placed on a tray for curing.
Figure 4:
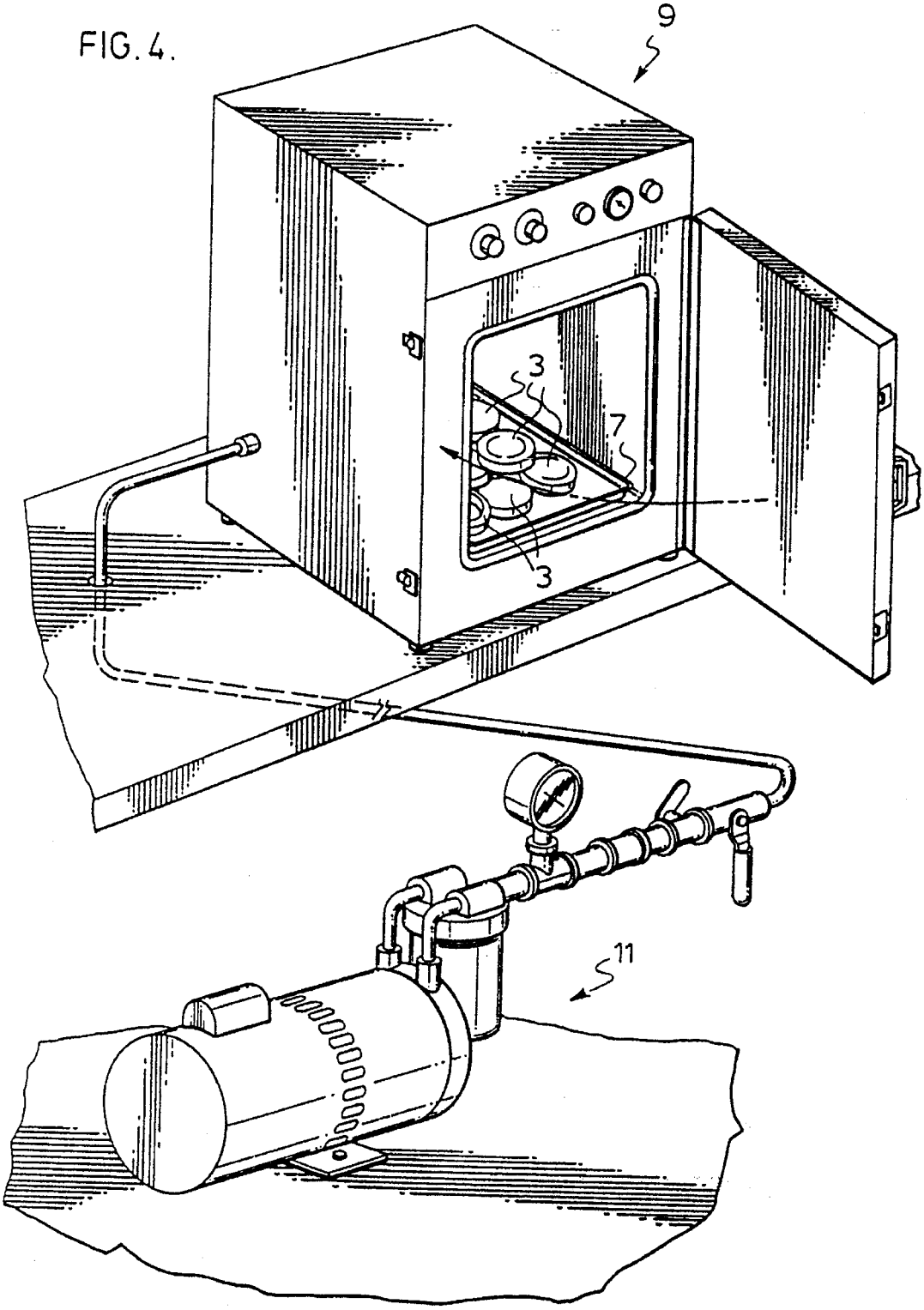
FIG. 4 shows the tray with slabs of mammoth ivory placed within a vacuum oven in accordance with the process of the present invention.

According to the second step of the stabilization process, the slabs 3 are placed on a tray 7 (FIG. 3) which is then placed within a specialized vacuum oven 9 (FIG. 4) attached to a vacuum pump 11. According to the preferred embodiment, the vacuum oven 9 is a Sargeant Welch, Squaroid Duo Vac™ oven and the vacuum pump 11 is a Gast, 0822-V103-G271X pump.

The slabs 3 remain in the oven 9 for six days at a temperature of approximately 65° C. The oven 9 heats the material while vacuum pump 11 pulls out all moisture at full atmospheric pressure.

The cured material is allowed to cool in the sealed chamber of the vacuum oven, and then must be immediately pressure impregnated before any transfer of humidity occurs.

According to the third step of the stabilization process (pressure impregnation), the rough mammoth ivory material is loaded into trays 13 (FIGS. 5 and 6), into which liquid epoxy 15 is poured. According to the preferred embodiment, Industrial Formulators 83HA4 polymer epoxy was used. In order to eliminate the possibility of future moisture entry, the epoxy must penetrate completely through the closed cell structure of the mammoth ivory. Therefore, a custom designed pressure vessel 17 is used. The trays 13 containing mammoth ivory immersed in liquid epoxy, are stacked in a vertical holder 19 which is then inserted into pressure vessel 17. The vessel 17 is closed via cap 21 and a vacuum pump (not shown) removes all air within the vessel 17 to full atmospheric pressure. A valve 23 is then closed to maintain this condition. The next stage involves opening a further valve 25 which allows 2000 psi of nitrogen into the vessel 17 from container 27. The injection of nitrogen into pressure vessel 17 forces the liquid epoxy 15 through the mammoth ivory pieces 3. The mammoth ivory pieces are then allowed to cure for 24 hours under this condition.

According to the preferred embodiment, pressure vessel 17 is a custom designed manufactured by Sureweld Industries.

The second processing steps is referred to herein as construction, and is also a three part process for assembly of the mammoth ivory pieces and gemstones without cracking and separation of joints.

Figure 7:
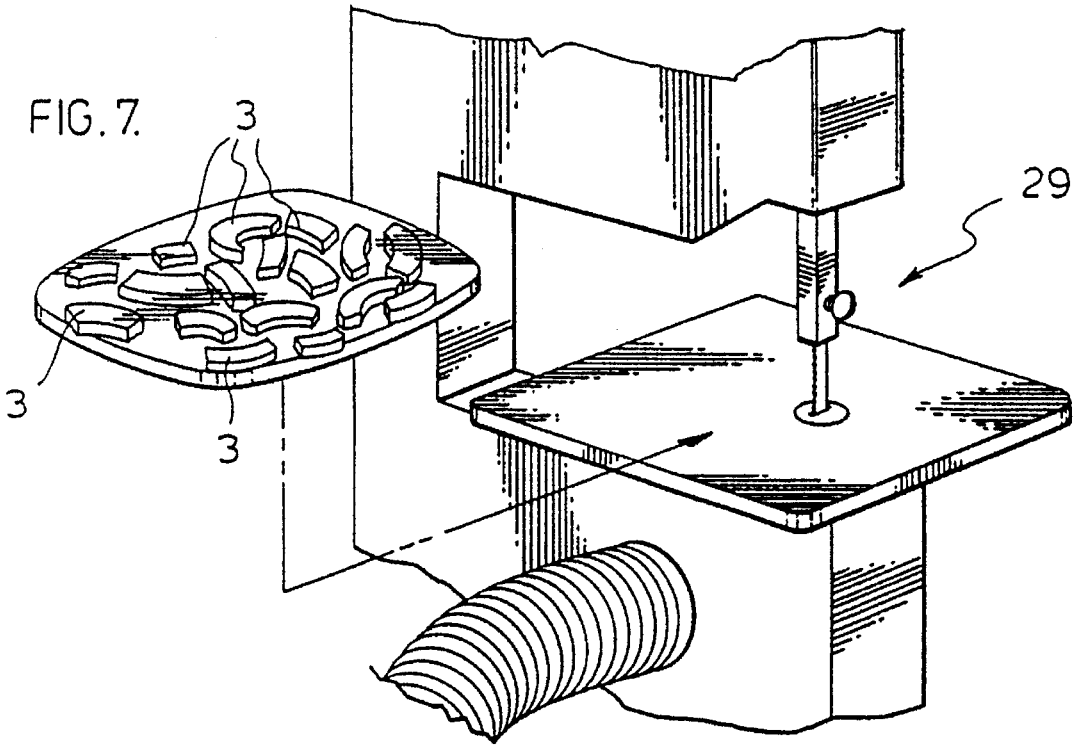
FIG. 7 shows a cutting machine for rough cutting shapes of mammoth ivory prior to construction, according to the process of the present invention.

With reference to FIG. 7, the rough mammoth ivory pieces 3 are cut into required shapes via cutting apparatus 29.

Figure 8:
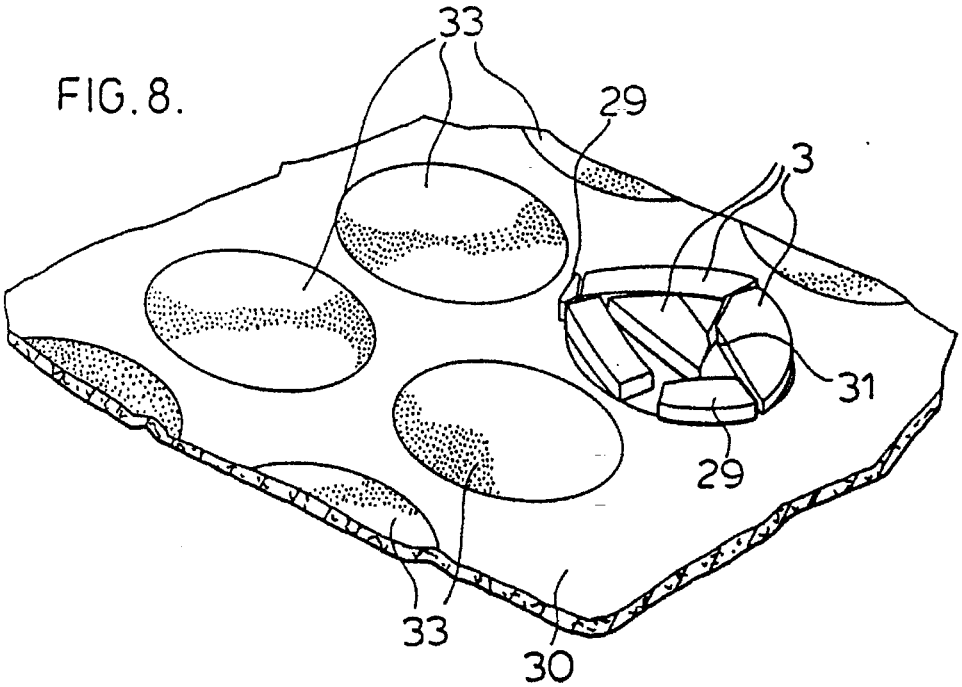
FIG. 8 shows pieces of mammoth ivory laid out in desired shapes and sizes on a sticky surface of a thin cardboard with gemstones inlaid among the pieces of mammoth ivory, according to the process of the present invention.

With reference to FIG. 8, the stabilized mammoth ivory pieces 3 (after cutting as shown in FIG. 7), are placed on a thin sheet of cardboard 30 in predetermined shapes, sizes and layouts as desired by the designer. Next, gemstones 31 are inlaid among the pieces of mammoth ivory 3 with sufficient expansion room between the two constituent elements. The mammoth ivory 3 and gemstones 31 are placed on a sticky portion 33 of the thin cardboard 30. According to the next step in the construction process, the assembled pieces of mammoth ivory and gemstones (the assembled pieces being referred to hereinafter as composite pieces 35) are inserted into trays 13 and immersed in liquid epoxy 15 (FIG. 9), and subjected to further pressure impregnation utilizing the pressure vessel 17 (see FIG. 10).

Suitable types of gemstones include tuquoise, sugulite, rhodochrosite, Ammolite™, amber, onyx, opal, chrysocolla, malachite, azurite malachite, coral, lapic lazuli.

Figure 11:
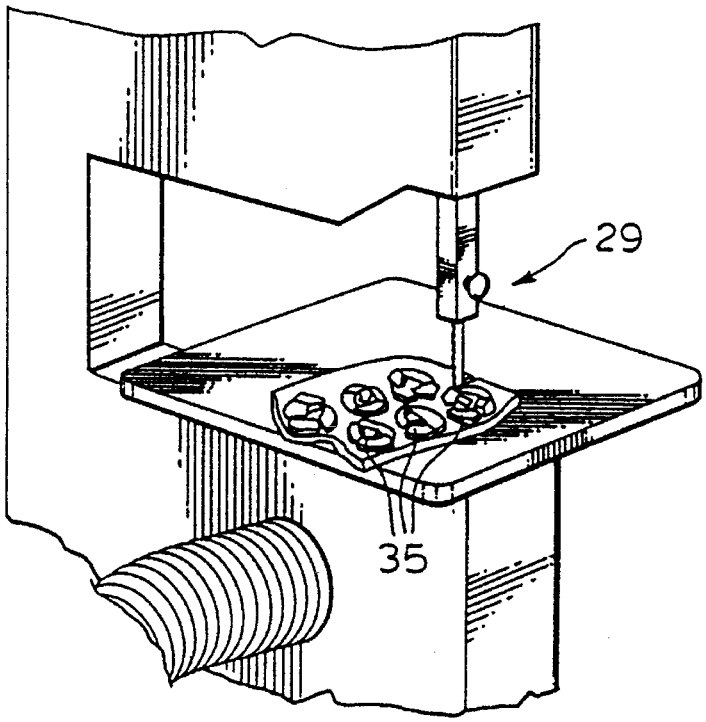
FIG. 11 shows the cutting apparatus of FIG. 7 for rough cutting and shaping the epoxy impregnated pieces of mammoth ivory and gemstone, according to the process of the present invention.
Figure 12:
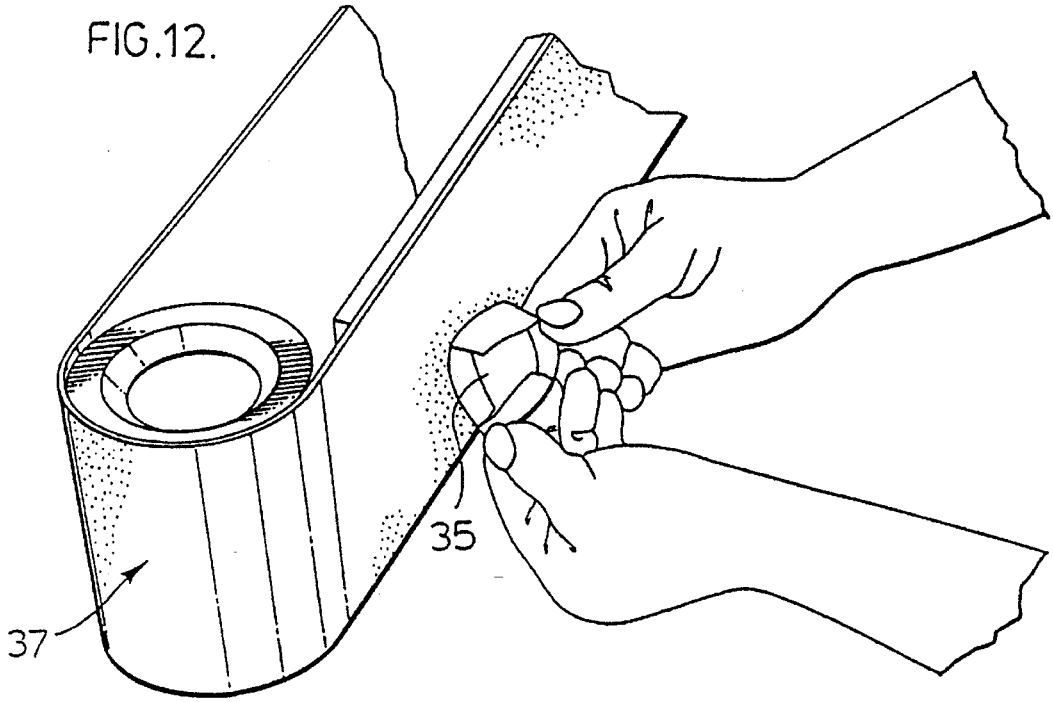
FIG. 12 shows a sanding belt for sanding the rough cut composite pieces of mammoth ivory and gemstone, according to the process of the present invention.
Figure 13:
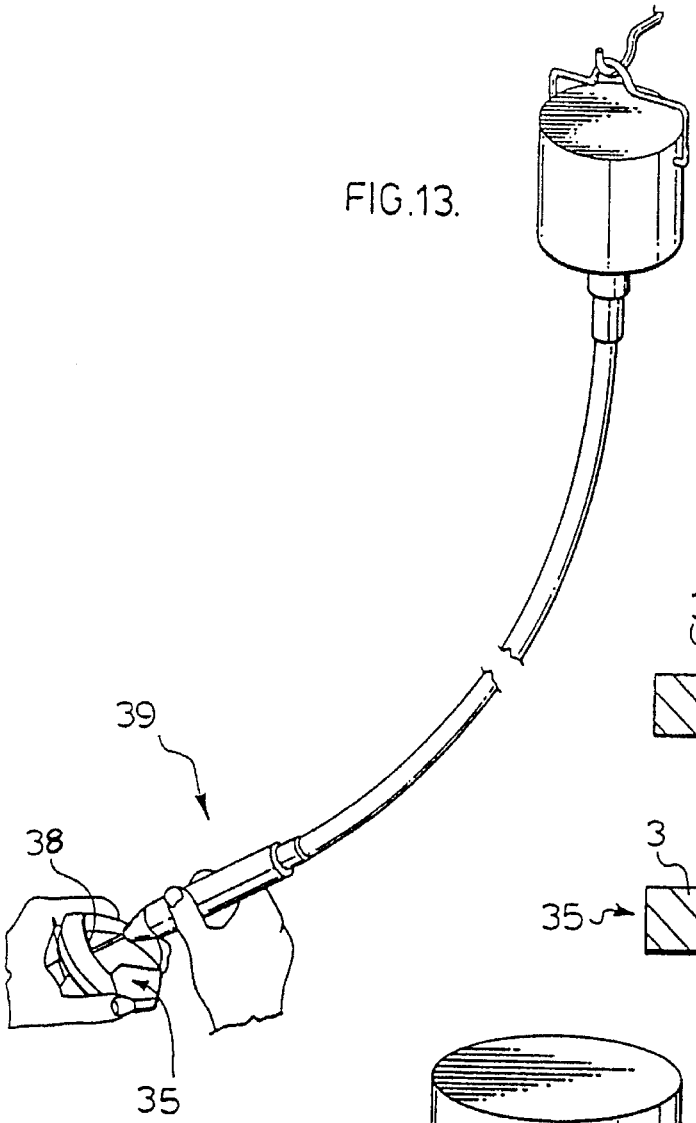
FIG. 13 shows removal of a shallow portion or bed of epoxy from between the gemstones and mammoth ivory utilizing a dremmel tool, according to the process of the present invention.
Figure 14A:
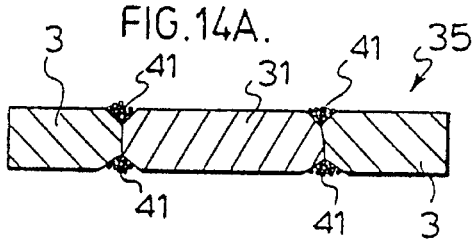
FIG. 14A shows deposition of gold alloy dust into the shallow bed removed from the epoxy utilizing the tool of FIG. 13.
Figure 14B:
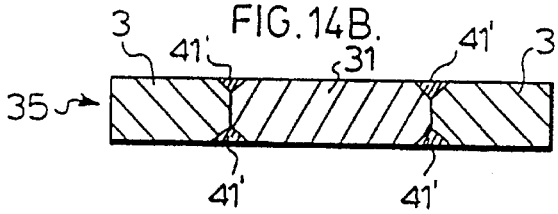
FIG. 14B shows the gold alloy dust fixed within the shallow bed with cyano-acrylid, according to the process of the present invention.
Figure 15:
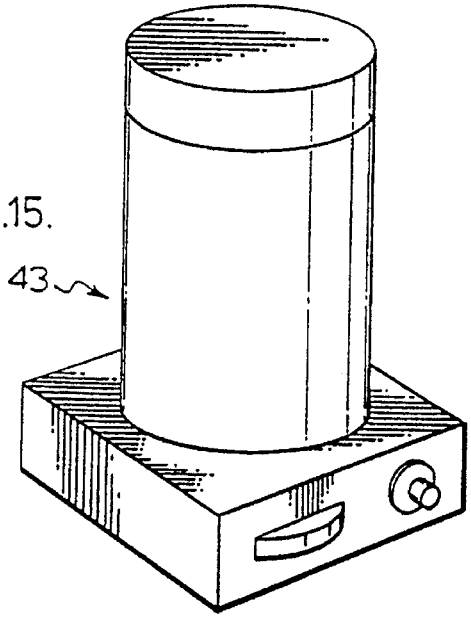
FIG. 15 shows a melting furnace used in the process for creating the gold alloy dust according to the present invention.

The final step in the construction process starts with rough shaping and sanding of the composite pieces 35 utilizing the cutting apparatus 29 (FIG. 11) and sanding belt 37 (FIG. 12). On both sides of each composite piece 35, a shallow portion or bed 38 of epoxy is removed from between the gemstones and mammoth ivory utilizing a dremmel tool 39, as shown in FIG. 13. This bed 37 is then inlaid with gold alloy dust 41 and affixed into the bed with cyano-acrylid, designated by reference 41' in FIG. 14B. This shallow bed of gold alloy and cyano-acrylid 41' is crucial in eliminating stone cracking and separation. If the portion is too deep, the amount of pressure allowed on the stone will be greater, and the surface retention of the epoxy is reduced between the constituent materials.

The maximum depth of the shallow bed is 2 mm, while the minimum depth is 2 mm.

According to the preferred embodiment, the gold alloy comprises a formulation of metals made by Imperial Smelting (ultra gold #1). The gold alloy is melted into bars utilizing melting furnace 43 and then ground to a fine powder utilizing a milling machine (not shown) having a titaloc cutting bit (not shown).

The processing stage of the present invention is also performed in three stages, and the objective is to provide a final shape to the jewelry piece and to bring forth a bright natural shine thereto.

According to the first step, the assembled composite pieces 35 are wet sanded on an expandable drum sander 45 (FIG. 16) to obtain the final shape and curvature of the jewelry piece and to eliminate any bevels or rough edges. A sequence of wet sanding is performed utilizing firstly 180 grit, then 400 grit, and then finally 600 grit silicone carbide sanding belts 46 for polishing the piece 35 to the desired lustre.

According to the preferred embodiment, expandable drum sander 45 is a Lortone model BA82.

Next, surface scratches are eliminated and the piece 35 is brought to a fine polish by a further simple sequence of sanding operations, this time utilizing a lapidary wheel 47 and diamond impregnated pads 49 starting at 400 grit, then 600 grit and finally 1200 grit. According to the preferred embodiment, the lapidary wheel 47 is a Gryphon, Lapidary Workshop system.

In the final stage, the piece 35 is brought to a glowing lustre utilizing the lapidary wheel 47 and a suede pad (not shown) which is coated with cerium oxide polishing compound having approximately 40,000 grit. Using this equipment, the piece is polished to a mirror-like finish. A final jewelry piece is shown with reference to FIG. 18.

The resulting jewelry piece 35 is characterized by high strength, absence of cracking in the mammoth ivory, absence of cracking in the inlaid gemstones and absence of separation of joints between the constituent materials.

Other embodiments and variations of the invention are possible. For example, different constituent materials (e.g. different gemstones) may be utilized, different designs and manufactures of vacuum ovens and equipment may be utilized, variations in construction and processing may also be effected. All such modifications and variations are believed to be within the sphere and scope of the present invention as defined by the claims appended herewith.

The embodiments of the invention in which an exclusive property or privilege is claimed are defined as follows:

1. A process for manufacturing mammoth ivory jewelry, comprising the steps of:

(a) slow curing a supply of rough mammoth ivory for partially drying said rough mammoth ivory;

(b) cutting said rough mammoth ivory into pieces;

(c) further curing said pieces of rough mammoth ivory by heating said pieces in a vacuum oven for removing moisture therefrom;

(d) immediately pressure impregnating said pieces with suitable material for preventing moisture entry into said pieces;

(e) inlaying gemstones between predetermined ones of said pieces to form composite pieces;

(f) further pressure impregnating said composite pieces with said material for bonding said gemstones and mammoth ivory pieces;

(g) removing a portion of the material from between the gemstones and mammoth ivory pieces so as to form a shallow bed in the composite pieces as such for eliminating cracking and separation of the gemstones and mammoth ivory pieces;

(h) inlaying the shallow bed with gold alloy dust for aesthetic appearance in said pieces; and (i) processing said composite pieces to acquire a final shape and polished appearance.

2. The process of claim 1, wherein said step of slow curing comprises storing said supply of rough mammoth ivory in low humidity for a predetermined period of time.

3. The process of claim 2, wherein said predetermined time is approximately two years.

4. The process of claim 1, wherein said step of cutting said rough mammoth ivory into pieces comprises cutting said rough mammoth ivory into slabs not thicker than approximately 3 cm.

5. The process of claim 1, wherein said step of further curing said pieces of rough mammoth ivory comprises heating said pieces in a vacuum oven at approximately 65° C. and full atmospheric pressure for approximately six days, and subsequently cooling said pieces.

6. The process of claim 1, wherein said step of pressure impregnating said pieces of rough mammoth ivory comprises immersing said pieces in liquid polymer epoxy, placing said pieces immersed in liquid polymer epoxy into a pressure vessel, removing air from said pressure vessel to full atmospheric pressure, pumping nitrogen into said pressure vessel to 2000 psi, and maintaining said pieces in said pressure vessel filled with said nitrogen for approximately 24 hours.

7. The process of claim 1, wherein said steps of inlaying gemstones between predetermined ones of said pieces comprises placing said pieces with said gemstones inlaid therebetween onto a thin cardboard with a sticky surface.

8. The process of claim 1, wherein said step of removing said portion of said material from between said gemstones and mammoth ivory pieces comprises etching said shallow bed into said material using a dremmel tool.

9. The process of claim 1, further comprising the step of rough shaping and sanding said composite pieces prior to removing said portion of said material from between said gemstones and mammoth ivory pieces.

10. The process of claim 1, wherein said step of inlaying said shallow bed with gold alloy dust further comprises depositing and affixing said gold alloy dust in said shallow bed with cyano-acrylid.

11. The process of claim 1, wherein said steps of processing said composite pieces further comprises the steps of:

(i) wet sanding said composite pieces on an expandable drum sander first with 180 grit, then with 400 grit, and finally with 600 grit silicone carbide sanding belts for shaping and curving said composite pieces and eliminating bevels and rough edges;

(ii) further sanding said composite pieces using a lapidary wheel with diamond impregnated pads first at 400 grit, then 600 grit, and finally at 1200 grit; and (iii) polishing said composite pieces using said lapidary wheel with a suede pad coated with cerium oxide polishing compound of approximately 40,000 grit.

* * * * *